US008660271B2

(12) United States Patent
Wang et al.

(10) Patent No.: US 8,660,271 B2
(45) Date of Patent: Feb. 25, 2014

(54) STEREO IMAGE WIDENING SYSTEM

(75) Inventors: Wen Wang, Cupertino, CA (US); James Tracey, Laguna Niguel, CA (US); Robert C. Maling, III, Huntington Beach, CA (US); Themis Katsianos, Highland, CA (US)

(73) Assignee: DTS LLC, Calabasas, CA (US)

( * ) Notice: Subject to any disclaimer, the term of this patent is extended or adjusted under 35 U.S.C. 154(b) by 104 days.

(21) Appl. No.: 13/277,978

(22) Filed: Oct. 20, 2011

(65) Prior Publication Data

US 2012/0099733 A1 Apr. 26, 2012

Related U.S. Application Data

(60) Provisional application No. 61/405,115, filed on Oct. 20, 2010.

(51) Int. Cl.
*H04R 5/00* (2006.01)
*H04R 5/02* (2006.01)

(52) U.S. Cl.
USPC ..... 381/17; 381/309; 381/18

(58) Field of Classification Search
USPC ..... 381/1, 17–23, 307, 309, 26, 74
See application file for complete search history.

(56) References Cited

U.S. PATENT DOCUMENTS

| | | | | |
|---|---|---|---|---|
| 5,034,983 | A | 7/1991 | Cooper et al. | |
| 5,333,200 | A | 7/1994 | Cooper et al. | |
| 5,581,618 | A | 12/1996 | Satoshi et al. | |
| 5,666,425 | A | 9/1997 | Sibbald et al. | |
| 6,009,178 | A | 12/1999 | Abel et al. | |
| 6,307,941 | B1 | 10/2001 | Tanner, Jr. et al. | |
| 6,424,719 | B1 | 7/2002 | Elko et al. | |
| 6,577,736 | B1 | 6/2003 | Clemow | |
| 6,668,061 | B1 * | 12/2003 | Abel | 381/1 |
| 7,072,474 | B2 | 7/2006 | Nelson et al. | |
| 7,167,567 | B1 | 1/2007 | Sibbald et al. | |
| 7,536,017 | B2 * | 5/2009 | Sakurai et al. | 381/17 |
| 8,050,433 | B2 * | 11/2011 | Kim | 381/309 |
| 2003/0161478 | A1 | 8/2003 | Nelson et al. | |
| 2005/0254660 | A1 | 11/2005 | Sakurai et al. | |
| 2005/0271214 | A1 | 12/2005 | Kim | |
| 2006/0239464 | A1 | 10/2006 | Lee et al. | |
| 2007/0076892 | A1 | 4/2007 | Kim | |
| 2007/0223750 | A1 | 9/2007 | Bai et al. | |
| 2007/0269061 | A1 | 11/2007 | Kim et al. | |
| 2008/0279401 | A1 | 11/2008 | Bharitkar et al. | |
| 2009/0086982 | A1 | 4/2009 | Kulkarni et al. | |
| 2009/0262947 | A1 | 10/2009 | Karlsson et al. | |

OTHER PUBLICATIONS

Weissgerber et al., "*Headphone Reproduction via Loudspeakers Using Inverse HRTF-Filters*", NAG/DAGA Rotterdam, pp. 1291-1294 (2009).

Acoustic Dipoles, http://www.1-1-1-1.net/orgs/dipoles.htm, retrieved Oct. 1, 2011.

International Search Report and Written Opinion issued in application No. PCT/US11/57135 on Feb. 14, 2012.

* cited by examiner

*Primary Examiner* — Xu Mei
(74) *Attorney, Agent, or Firm* — Knobbe Martens Olson & Bear LLP

(57) ABSTRACT

A stereo widening system and associated signal processing algorithms are described herein that can, in several embodiments, widen a stereo image with fewer processing resources than existing crosstalk cancellation systems. These system and algorithms can advantageously be implemented in a handheld device or other device with speakers placed close together, thereby improving the stereo effect produced with such devices at lower computational cost. However, the systems and algorithms described herein are not limited to handheld devices, but can more generally be implemented in any device with multiple speakers.

8 Claims, 11 Drawing Sheets

STEREO IMAGE WIDENING SYSTEM

RELATED APPLICATION

This application claims priority under 35 U.S.C. §119(e) to U.S. Provisional Application No. 61/405,115 filed Oct. 20, 2010, entitled "Stereo Image Widening System," the disclosure of which is hereby incorporated by reference in its entirety.

BACKGROUND

Stereo sound can be produced by separately recording left and right audio signals using multiple microphones. Alternatively, stereo sound can be synthesized by applying a binaural synthesis filter to a monophonic signal to produce left and right audio signals. Stereo sound often has excellent performance when a stereo signal is reproduced through a headphone. However, if the signal is reproduced through two loudspeakers, crosstalk between the two speakers and the ears of a listener can occur such that a stereo perception is degraded. Accordingly, a crosstalk canceller is often employed to cancel or reduce the crosstalk between both signals so that a left speaker signal is not heard in a listener's right ear and a right speaker signal is not heard in the listener's left ear.

SUMMARY

A stereo widening system and associated signal processing algorithms are described herein that can, in certain embodiments, widen a stereo image with fewer processing resources than existing crosstalk cancellation systems. These system and algorithms can advantageously be implemented in a handheld device or other device with speakers placed close together, thereby improving the stereo effect produced with such devices at lower computational cost. However, the systems and algorithms described herein are not limited to handheld devices, but can more generally be implemented in any device with multiple speakers.

For purposes of summarizing the disclosure, certain aspects, advantages and novel features of the inventions have been described herein. It is to be understood that not necessarily all such advantages can be achieved in accordance with any particular embodiment of the inventions disclosed herein. Thus, the inventions disclosed herein can be embodied or carried out in a manner that achieves or optimizes one advantage or group of advantages as taught herein without necessarily achieving other advantages as can be taught or suggested herein.

In certain embodiments, a method for virtually widening stereo audio signals played over a pair of loudspeakers includes receiving stereo audio signals, where the stereo audio signals including a left audio signal and a right audio signal. The method can further include supplying the left audio signal to a left channel and the right audio signal to a right channel and employing acoustic dipole principles to mitigate effects of crosstalk between a pair of loudspeakers and opposite ears of a listener, without employing any computationally-intensive head-related transfer functions (HRTFs) or inverse HRTFs in an attempt to completely cancel the crosstalk. The employing can include (by one or more processors): approximating a first acoustic dipole by at least (a) inverting the left audio signal to produce a inverted left audio signal and (b) combining the inverted left audio signal with the right audio signal, and approximating a second acoustic dipole by at least (a) inverting the right audio signal to produce a inverted right audio signal and (b) combining the inverted right audio signal with the left audio signal; applying a single first inverse HRTF to the first acoustic dipole to produce a left filtered signal. The first inverse HRTF can be applied in a first direct path of the left channel rather than a first crosstalk path from the left channel to the right channel. The method can further include applying a single second inverse HRTF function to the second acoustic dipole to produce a right filtered signal, where the second inverse HRTF can be applied in a second direct path of the right channel rather than a second crosstalk path from the right channel to the left channel, and where the first and second inverse HRTFs provide an interaural intensity difference (IID) between the left and right filtered signals. Moreover, the method can include supplying the left and right filtered signals for playback on the pair of loudspeakers to thereby provide a stereo image configured to be perceived by the listener to be wider than an actual distance between the left and right loudspeakers.

In some embodiments, a system for virtually widening stereo audio signals played over a pair of loudspeakers includes an acoustic dipole component that can: receive a left audio signal and a right audio signal, approximate a first acoustic dipole by at least (a) inverting the left audio signal to produce an inverted left audio signal and (b) combining the inverted left audio signal with the right audio signal, and approximate a second acoustic dipole by at least (a) inverting the right audio signal to produce a inverted right audio signal and (b) combining the inverted right audio signal with the left audio signal. The system can also include an interaural intensity difference (IID) component that can: apply a single first hearing response function to the first acoustic dipole to produce a left filtered signal, and apply a single second hearing response function to the second acoustic dipole to produce a right filtered signal. The system can supply the left and right filtered signals for playback by left and right loudspeakers to thereby provide a stereo image configured to be perceived by a listener to be wider than an actual distance between the left and right loudspeakers. Further, the acoustic dipole component and the IID component can be implemented by one or more processors.

In some embodiments, non-transitory physical electronic storage having processor-executable instructions stored thereon that, when executed by one or more processors, implement components for virtually widening stereo audio signals played over a pair of loudspeakers. These components can include an acoustic dipole component that can: receive a left audio signal and a right audio signal, form a first simulated acoustic dipole by at least (a) inverting the left audio signal to produce an inverted left audio signal and (b) combining the inverted left audio signal with the right audio signal, and form a second simulated acoustic dipole by at least (a) inverting the right audio signal to produce a inverted right audio signal and (b) combining the inverted right audio signal with the left audio signal. The components can also include an interaural intensity difference (IID) configured to: apply a single first inverse head-related transfer function (HRTF) to the first simulated acoustic dipole to produce a left filtered signal, and apply a single second inverse HRTF to the second simulated acoustic dipole to produce a right filtered signal.

BRIEF DESCRIPTION OF THE DRAWINGS

Throughout the drawings, reference numbers can be reused to indicate correspondence between referenced elements. The drawings are provided to illustrate embodiments of the inventions described herein and not to limit the scope thereof.

DETAILED DESCRIPTION

I. Introduction

Portable electronic devices typically include small speakers that are closely spaced together. Being closely spaced together, these speakers tend to provide poor channel separation, resulting in a narrow sound image. As a result, it can be very difficult to hear stereo and 3D sound effects over such speakers. Current crosstalk cancellation algorithms aim to mitigate these problems by reducing or cancelling speaker crosstalk. However, these algorithms can be computationally costly to implement because they tend to employ multiple head-related transfer functions (HRTFs). For example, common crosstalk cancellation algorithms employ four or more HRTFs, which can be too computationally costly to perform with a mobile device having limited computing resources.

Advantageously, in certain embodiments, audio systems described herein provide stereo widening with reduced computing resource consumption compared with existing crosstalk cancellation approaches. In one embodiment, the audio systems employ a single inverse HRTF in each channel path instead of multiple HRTFs. Removing HRTFs that are commonly used in crosstalk cancellation obviates an underlying assumption of crosstalk cancellation, which is that the transfer function of the canceled crosstalk path should be zero. However, in certain embodiments, implementing acoustic dipole features in the audio system can advantageously allow this assumption to be ignored while still providing stereo widening and potentially at least some crosstalk reduction.

The features of the audio systems described herein can be implemented in portable electronic devices, such as phones, laptops, other computers, portable media players, and the like to widen the stereo image produced by speakers internal to these devices or external speakers connected to these devices. The advantages of the systems described herein may be most pronounced, for some embodiments, in mobile devices such as phones, tablets, laptops, or other devices with speakers that are closely spaced together. However, at least some of the benefits of the systems described herein may be achieved with devices having speakers that are spaced farther apart than mobile devices, such as televisions and car stereo systems, among others. More generally, the audio system described herein can be implemented in any audio device, including devices having more than two speakers.

II. Example Stereo Image Widening Features

Figure 1:
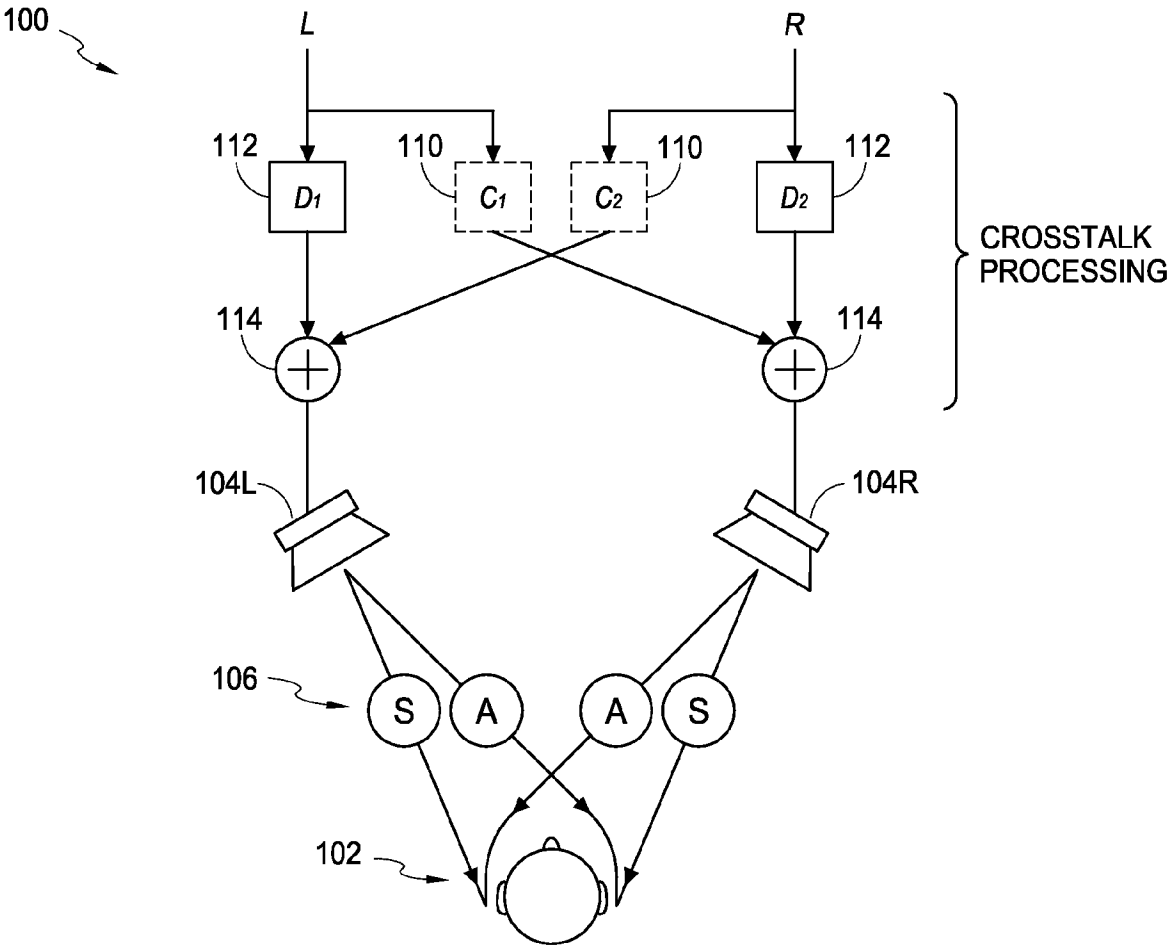
FIG. 1 illustrates an embodiment of a crosstalk reduction scenario.

With reference to the drawings, FIG. 1 illustrates an embodiment of a crosstalk reduction scenario 100. In the scenario 100, a listener 102 listens to sound emanating from two loudspeakers 104, including a left speaker 104L and a right speaker 104R. Transfer functions 106 are also shown, representing relationships between the outputs of the speakers 104 and the sound received in the ears of the listener 102. These transfer functions 106 include same-side path transfer functions ("S") and alternate side path transfer functions ("A"). The "A" transfer functions 106 in the alternate side paths result in crosstalk between each speaker and the opposite ear of the listener 102.

The aim of existing crosstalk cancellation techniques is to cancel the "A" transfer functions so that the "A" transfer functions have a value of zero. In order to do this, such techniques may perform crosstalk processing as shown in the upper-half of FIG. 1. This processing often begins by receiving left (L) and right (R) audio input signals and providing these signals to multiple filters 110, 112. Both crosstalk path filters 110 and direct path filters 112 are shown. The crosstalk and direct path filters 110, 112 can implement HRTFs that manipulate the audio input signals so as to cancel the crosstalk. The crosstalk path filters 110 perform the bulk of crosstalk cancellation, which itself may produce secondary crosstalk effects. The direct path filters 112 can reduce or cancel these secondary crosstalk effects.

A common scheme is to set each of the crosstalk path filters 110 equal to −A/S (or estimates thereof), where A and S are the transfer functions 106 described above. The direct path filters 112 may be implemented using various techniques, some examples of which are shown and described in FIG. 4 of U.S. Pat. No. 6,577,736, filed Jun. 14, 1999, and entitled "Method of Synthesizing a Three Dimensional Sound-Field," the disclosure of which is hereby incorporated by reference in its entirety. The output of the crosstalk path filters 110 are combined with the output of the direct path filters 112 using combiner blocks 114 in each of the respective channels to produce output audio signals. It should be noted that the order of filtering may be reversed, for example, by placing the direct path filters 112 between the combiner blocks 114 and the speakers 104.

One of the disadvantages of crosstalk cancellers is that the head of a listener needs to be placed precisely in the middle of or within a small sweet spot between the two speakers 104 in order to perceive the crosstalk cancellation effect. However, listeners may have a difficult time identifying such a sweet spot or may naturally move around, in and out of the sweet spot, reducing the crosstalk cancellation effect. Another disadvantage of crosstalk cancellation is that the HRTFs employed can differ from the actual hearing response function of a particular listener's ears. The crosstalk cancellation algorithm may therefore work better for some listeners than others.

In addition to these disadvantages in the effectiveness of crosstalk cancellation, the computation of −A/S employed by the crosstalk path filters 110 can be computationally costly. In mobile devices or other devices with relatively low computing power, it can be desirable to eliminate this crosstalk computation. Systems and methods described herein do, in fact, eliminate this crosstalk computation. The crosstalk path filters 110 are therefore shown in dotted lines to indicate that they can be removed from the crosstalk processing. Removing these filters 110 is counterintuitive because these filters 110 perform the bulk of the crosstalk cancellation. Without these filters 110, the alternative side path transfer functions (A) may not be zero-valued. However, these crosstalk filters 110 can advantageously be removed while still providing good stereo separation by employing the principles of acoustic dipoles (among possibly other features).

In certain embodiments, acoustic dipoles used in crosstalk reduction can also increase the size of the sweet spot over existing crosstalk algorithms and can compensate for HRTFs that do not precisely match individual differences in hearing response functions. In addition, as will be described in greater detail below, the HRTFs used in crosstalk cancellation can be adjusted to facilitate eliminating the crosstalk path filters 110 in certain embodiments.

Figure 2:
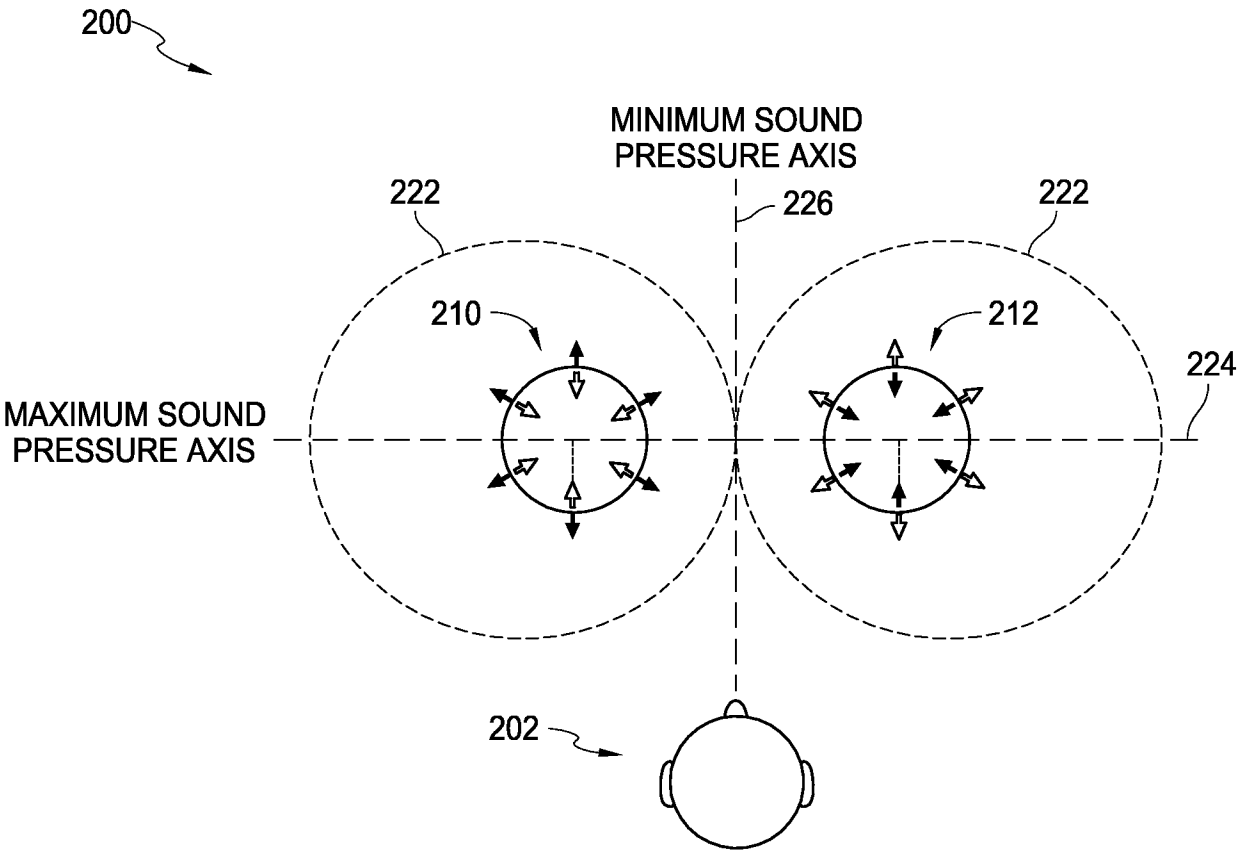
FIG. 2 illustrates the principles of an ideal acoustic dipole, which can be used to widen a stereo image.

To help explain how the audio systems described herein can use acoustic dipole principles, FIG. 2 illustrates an ideal acoustic dipole 200. The dipole 200 includes two point sources 210, 212 that radiate acoustic energy equally but in opposite phase. The dipole 200 produces a radiation pattern that, in two dimensions, includes two lobes 222 with maximum acoustic radiation along a first axis 224 and minimum acoustic radiation along a second axis 226 perpendicular to the first axis 224. The second axis 226 of minimum acoustic radiation lies between the two point sources 210, 212. Thus, a listener 202 placed along this axis 226, between the sources 210, 212, may perceive a wide stereo image with little or no crosstalk.

A physical approximation of an ideal acoustic dipole 200 can be constructed by placing two speakers back-to-back and by feeding one speaker with an inverted version of the signal fed to the other. Speakers in mobile devices typically cannot be rearranged in this fashion, although a device can be designed with speakers in such a configuration in some embodiments. However, an acoustic dipole can be simulated or approximated in software or circuitry by reversing the polarity of one audio input and combining this reversed input with the opposite channel. For instance, a left channel input can be inverted (180 degrees) and combined with a right channel input. The noninverted left channel input can be supplied to a left speaker, and the right channel input and inverted left channel input (R-L) can be supplied to a right speaker. The resulting playback would include a simulated acoustic dipole with respect to the left channel input.

Similarly, the right channel input can be inverted and combined with the left channel input (to produce L-R), creating a second acoustic dipole. Thus, the left speaker can output an L-R signal while the right speaker can output an R-L signal. Systems and processes described herein can perform this acoustic dipole simulation with one or two dipoles to increase stereo separation, optionally with other processing.

Figure 3:
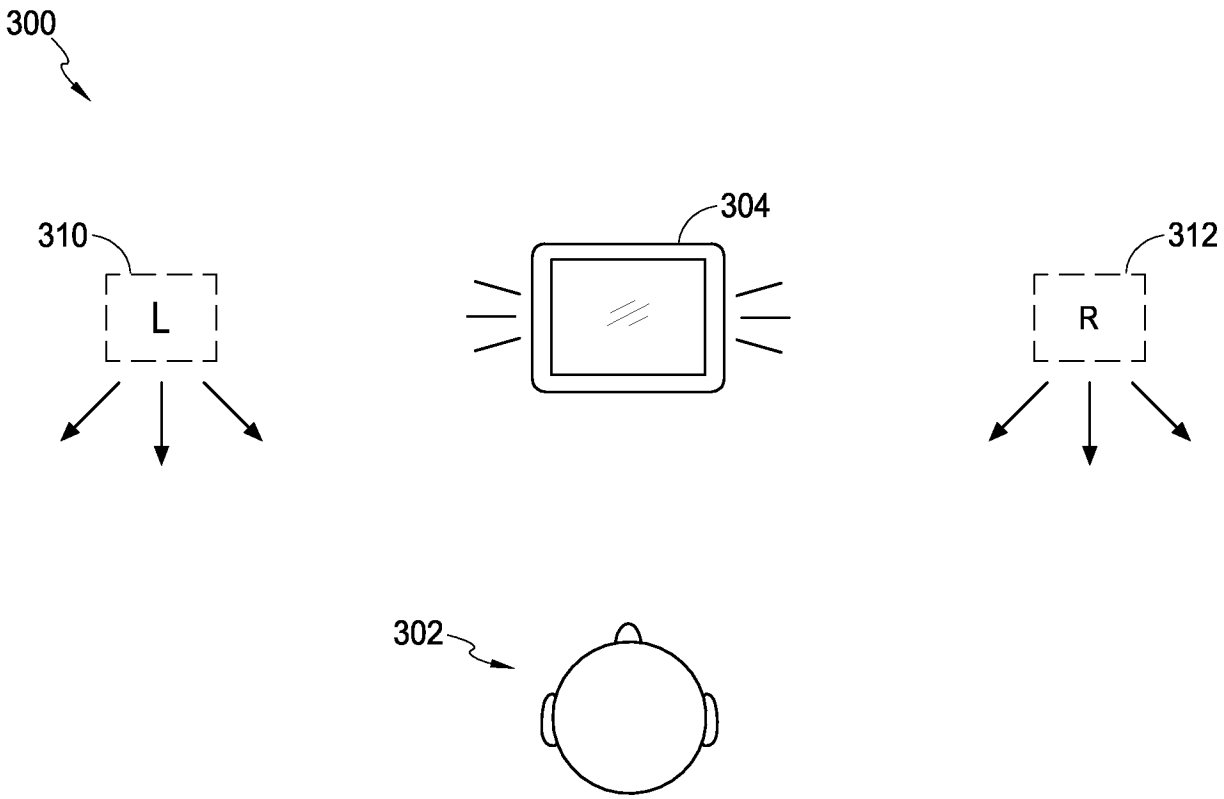
FIG. 3 illustrates an example listening scenario that employs a widened stereo image to enhance an audio experience for a listener.

FIG. 3 illustrates an example listening scenario 300 that employs acoustic dipole technology to widen a stereo image and thereby enhance an audio experience for a listener. In the scenario 300, a listener 302 listens to audio output by a mobile device 304, which is a tablet computer. The mobile device 304 includes two speakers (not shown) that are spaced relatively close together due to the small size of the device. Stereo widening processing, using simulated acoustic dipoles and possibly other features described herein, can create a widened perception of stereo sound for the listener 302. This stereo widening is represented by two virtual speakers 310, 312, which are virtual sound sources that the listener 302 can perceive as emanating the sound. Thus, the stereo widening features described herein can create the perception of sound sources that are farther apart than the physical distance between the actual speakers in the device 304. Advantageously, with acoustic dipoles increasing stereo separation, the crosstalk cancellation assumption of setting the crosstalk path equal to zero can be ignored. Among potentially other benefits, individual differences in HRTFs can affect the listening experience less than in typical crosstalk cancellation algorithms.

Figure 4:
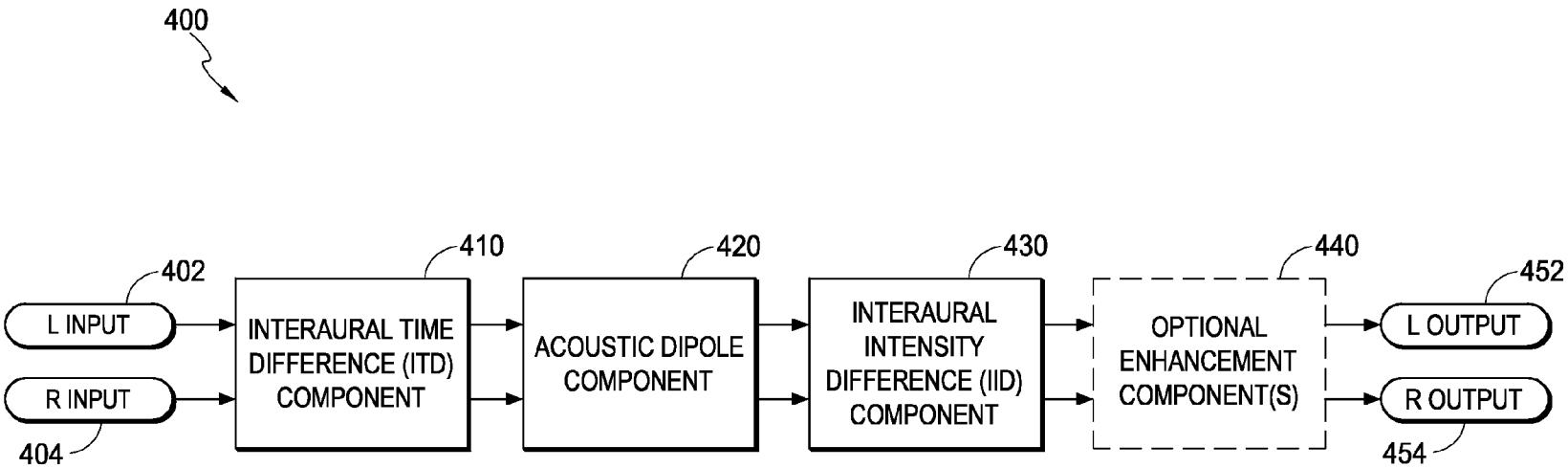
FIG. 4 illustrates an embodiment of a stereo widening system.

FIG. 4 illustrates an embodiment of a stereo widening system 400. The stereo widening system 400 can implement the acoustic dipole features described above. In addition, the stereo widening system 400 includes other features for widening and otherwise enhancing stereo sound.

The components shown include an interaural time difference (ITD) component 410, an acoustic dipole component 420, an interaural intensity difference (IID) component 430, and an optional enhancement component 440. Each of these components can be implemented in hardware and/or software. In addition, at least some of the components shown may be omitted in some embodiments, and the order of the components may also be rearranged in some embodiments.

The stereo widening system 400 receives left and right audio inputs 402, 404. These inputs 402, 404 are provided to an interaural time difference (ITD) component. The ITD component can use one or more delays to create an interaural time difference between the left and right inputs 402, 404. This ITD between inputs 402, 404 can create a sense of width or directionality between loudspeaker outputs. The amount of delay applied by the ITD component 410 can depend on metadata encoded in the left and right inputs 402, 404. This metadata can include information regarding the positions of sound sources in the left and right inputs 402, 404. Based on the position of the sound source, the ITD component 410 can create the appropriate delay to make the sound appear to be coming from the indicated sound source. For example, if the sound is to come from the left, the ITD component 410 may apply a delay to the right input 404 and not to the left input 402, or a greater delay to the right input 404 than to the left input 402. In some embodiments, the ITD component 410 calculates the ITD dynamically, using some or all of the concepts described in U.S. Pat. No. 8,027,477, filed Sep. 13, 2006, titled "Systems and Methods for Audio Processing" ("the '477 patent"), the disclosure of which is hereby incorporated by reference in its entirety.

The ITD component 410 provides left and right channel signals to the acoustic dipole component 420. Using the acoustic dipole principles described above with respect to FIG. 3, the acoustic dipole component 420 simulates or approximates acoustic dipoles. To illustrate, the acoustic dipole component 420 can invert both the left and right channel signals and combine the inverted signals with the opposite channel. As a result, the sound waves produced by two speakers can cancel out or be otherwise reduced between the two speakers. For convenience, the remainder of this specification refers to a dipole created by combining an inverted left channel signal with a right channel signal as a "left acoustic dipole," and a dipole created by combining an inverted right channel signal with a left channel signal as a "right acoustic dipole."

In one embodiment, to adjust the amount of acoustic dipole effect, the acoustic dipole component 420 can apply a gain to the inverted signal that is to be combined with the opposite channel signal. The gain can attenuate or increase the inverted signal magnitude. In one embodiment, the amount of gain applied by the acoustic dipole component 420 can depend on the actual physical separation with of two loudspeakers. The closer together two speakers are, the less gain the acoustic dipole component 420 can apply in some embodiments, and vice versa. This gain can effectively create an interaural intensity difference between the two speakers. This effect can be adjusted to compensate for different speaker configurations. For example, the stereo widening system 400 may provide a user interface having a slider, text box, or other user interface control that enables a user to input the actual physical width of the speakers. Using this information, the acoustic dipole component 420 can adjust the gain applied to the inverted signals accordingly. In some embodiments, this gain can be applied at any point in the processing chain represented in FIG. 4, and not only by the acoustic dipole component 420. Alternatively, no gain is applied.

Any gain applied by the acoustic dipole component 420 can be fixed based on the selected width of the speakers. In another embodiment, however, the inverted signal path gain depends on the metadata encoded in the left or right audio inputs 402, 404 and can be used to increase a sense of directionality of the inputs 402, 404. A stronger left acoustic dipole might be created using the gain on the left inverted input, for instance, to create a greater separation in the left signal than the right signal, or vice versa.

The acoustic dipole component 420 provides processed left and right channel signals to an interaural intensity difference (IID) component 430. The IID component 430 can create an interaural intensity difference between two channels or speakers. In one implementation, the IID component 430 applies the gain described above to one or both of the left and right channels, instead of the acoustic dipole component 420 performing this gain. The IID component 430 can change these gains dynamically based on sound position information encoded in the left and right inputs 402, 404. A difference in gain in each channel can result in an IID between a user's ears, giving the perception that sound in one channel is closer to the listener than another. Any gain applied by the IID component 430 can also compensate for the lack of differences in individual inverse HRTFs applied to each channel in some embodiments. As will be described in greater detail below, a single inverse HRTF can be applied to each channel, and an IID and/or ITD can be applied to produce or enhance a sense of separation between the channels.

In addition to or instead of a gain in each channel, the IID component 430 can include an inverse HRTF in one or both channels. Further, the inverse HRTF can be selected so as to reduce crosstalk (described below). The inverse HRTFs can be assigned different gains, which may be fixed to enhance a stereo effect. Alternatively, these gains can be variable based on the speaker configuration, as discussed below.

In one embodiment, the IID component 430 can access one of several inverse HRTFs for each channel, which the IID component 430 selected dynamically to produce a desired directionality. Together, the ITD component, acoustic dipole component 420, and the IID component 430 can influence the perception of a sound source's location. The IID techniques described in the '477 patent incorporated above may also be used by the IID component. In addition, simplified inverse HRTFs can be used as described in the '477 patent.

In certain embodiments, the ITD, acoustic dipoles, and/or IID created by the stereo widening system 400 can compensate for the crosstalk path (see FIG. 1) not having a zero-valued transfer function. Thus, in certain embodiments, channel separation can be provided with fewer computing resources than are used with existing crosstalk cancellation algorithms. It should be noted, however, that one or more of the components shown can be omitted while still providing some degree of stereo separation.

An optional enhancement component 440 is also shown. One or more enhancement components 440 can be provided with the stereo widening system 400. Generally speaking, the enhancement component 440 can adjust some characteristic of the left and right channel signals to enhance the audio playback of such signals. In the depicted embodiment, the optional enhancement component 440 receives left and right channel signals and produces left and right output signals 452, 454. The left and right output signals 452, 454 may be fed to left and right speakers or to other blocks for further processing.

The enhancement component 440 may include features for spectrally manipulating audio signals so as to improve playback on small speakers, some examples of which are described below with respect to FIG. 4. More generally, the enhancement component 440 can include any of the audio enhancements described in any of the following U.S. Patents and Patent Publications of SRS Labs, Inc. of Santa Ana, Calif., among others: U.S. Pat. Nos. 5,319,713, 5,333,201, 5,459,813, 5,638,452, 5,912,976, 6,597,791, 7,031,474, 7,555,130, 7,764,802, 7,720,240, 2007/0061026, 2009/0161883, 2011/0038490, 2011/0040395, and 2011/0066428, each of the foregoing of which is hereby incorporated by reference in its entirety. Further, the enhancement component 440 may be inserted at any point in the signal path shown between the inputs 402, 404 and the outputs 452, 454.

The stereo widening system 400 may be provided in a device together with a user interface that provides functionality for a user to control aspects of the system 400. The user can be a manufacturer or vendor of the device or an end user of the device. The control could be in the form of a slider or the like, or optionally an adjustable value, which enables a user to (indirectly or directly) control the stereo widening effect generally or aspects of the stereo widening effect individually. For instance, the slider can be used to generally select a wider or narrower stereo effect. More sliders may be provided in another example to allow individual characteristics of the stereo widening system to be adjusted, such as the ITD, the inverted signal path gain for one or both dipoles, or the IID, among other features. In one embodiment, the stereo widening systems described herein can provide separation in a mobile phone of up to about 4-6 feet (about 1.2-1.8 m) or more between left and right channels.

Although intended primarily for stereo, the features of the stereo widening system 400 can also be implemented in systems having more than two speakers. In a surround sound system, for example, the acoustic dipole functionality can be used to create one or more dipoles in the left rear and right rear surround sound inputs. Dipoles can also be created between front and rear inputs, or between front and center inputs, among many other possible configurations. Acoustic dipole technology used in surround sound settings can increase a sense of width in the sound field.

Figure 5:
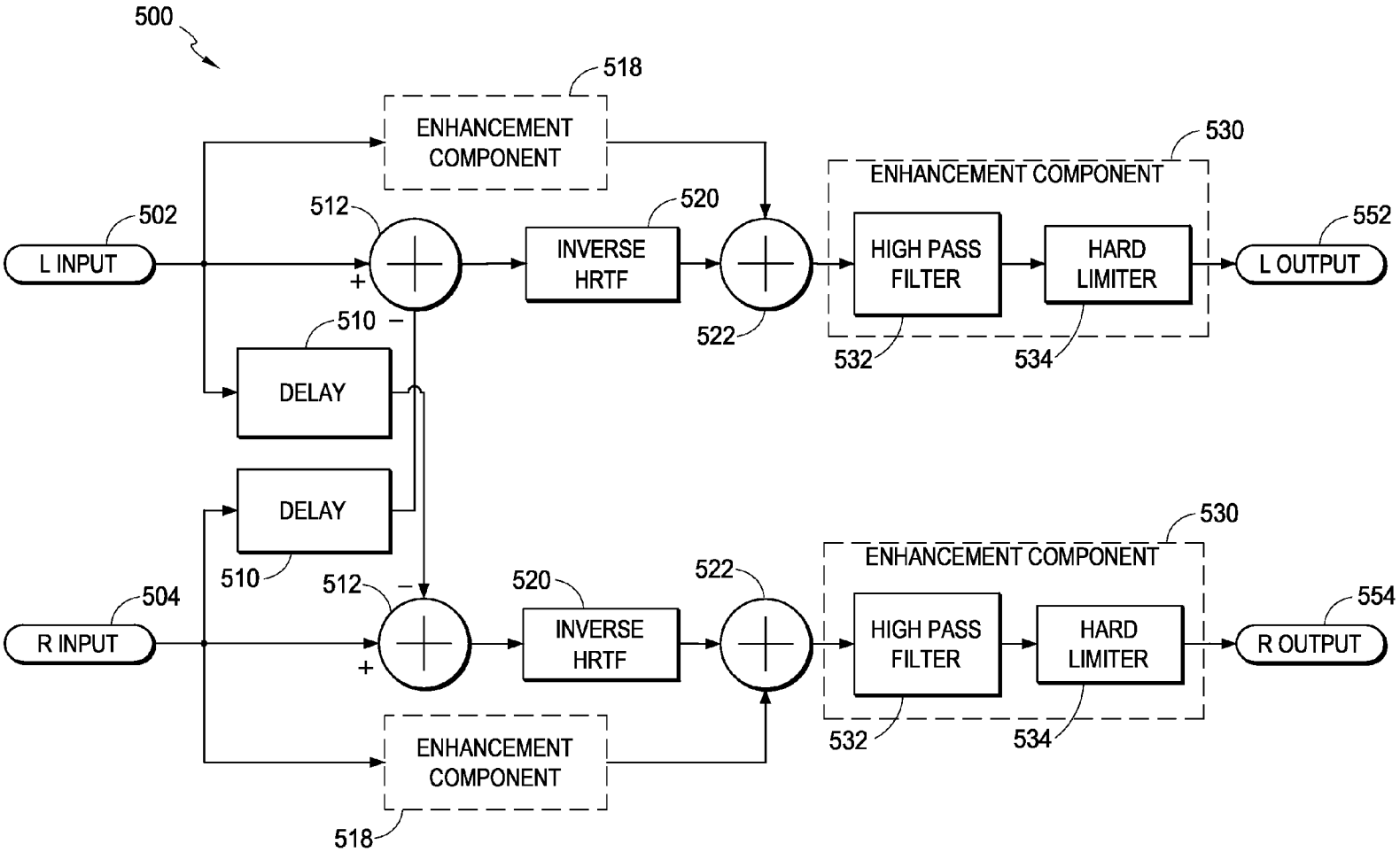
FIG. 5 illustrates a more detailed embodiment of the stereo widening system of FIG. 4.

FIG. 5 illustrates a more detailed embodiment of the stereo widening system 400 of FIG. 4, namely a stereo widening system 500. The stereo widening system 500 represents one example implementation of the stereo widening system 400 but can implement any of the features of the stereo widening system 400. The system 500 shown represents an algorithmic flow that can be implemented by one or more processors, such as a DSP processor or the like (including FPGA-based processors). The system 500 can also represent components that can be implemented using analog and/or digital circuitry.

The stereo widening system 500 receives left and right audio inputs 502, 504 and produces left and right audio outputs 552, 554. For ease of description, the direct signal path from the left audio input 502 to the left audio output 552 is referred to herein as the left channel, and the direct signal path from the right audio input 504 to the right audio output 554 is referred to herein as the right channel.

Each of the inputs 502, 504 is provided to delay blocks 510, respectively. The delay blocks 510 represent an example implementation of the ITD component 410. As described above, the delays 510 may be different in some embodiments to create a sense of widening or directionality of a sound field. The outputs of the delay blocks are input to combiners 512. The combiners 512 invert the delayed inputs (via the minus sign) and combine the inverted, delayed inputs with the left and right inputs 502, 504 in each channel. The combiners 512 therefore act to create acoustic dipoles in each channel. Thus, the combiners 512 are an example implementation of the acoustic dipole component 420. The output of the combiner 512 in the left channel, for instance, can be $L\text{-}R_{delayed}$, while the output of the combiner 512 in the right channel can be $R\text{-}L_{delayed}$. It should be noted that another way to implement the acoustic dipole component 420 is to provide an inverter between the delay blocks 510 and the combiners 512 (or before the delay blocks 510) and change the combiners 512 into adders (rather than subtracters).

The outputs of the combiners 512 are provided to inverse HRTF blocks 520. These inverse HRTF blocks 520 are example implementations of the IID component 430 described above. Advantageous characteristics of example implementations of the inverse HRTFs 520 are described in greater detail below. The inverse HRTFs 520 each output a filtered signal to a combiner 522, which in the depicted embodiment, also receives an input from an optional enhancement component 518. This enhancement component 518 takes as input a left or right signal 502, 504 (depending on the channel) and produces an enhanced output. This enhanced output will be described below.

The combiners 522 each output a combined signal to another optional enhancement component 530. In the depicted embodiment, the enhancement component 530 includes a high pass filter 532 and a limiter 534. The high pass filter 532 can be used for some devices, such as mobile phones, which have very small speakers that have limited bass-frequency reproduction capability. This high pass filter 532 can reduce any boost in the low frequency range caused by the inverse HRTF 520 or other processing, thereby reducing low-frequency distortion for small speakers. This reduction in low frequency content can, however, cause an imbalance of low and high frequency content, leading to a color change in sound quality. Thus, the enhancement component 518 referred to above can include a low pass filter to mix at least a low frequency portion of the original inputs 502, 504 with the output of the inverse HRTFs 520.

The output of the high pass filter 532 is provided to a hard limiter 534. The hard limiter 534 can apply at least some gain to the signal while also reducing clipping of the signal. More generally, in some embodiments, the hard limiter 534 can emphasize low frequency gains while reducing clipping or signal saturation in high frequencies. As a result, the hard limiter 534 can be used to help create a substantially flat frequency response that does not substantially change the color of the sound (see FIG. 11). In one embodiment, the hard limiter 534 boosts lower frequency gains, below some threshold determined experimentally, while applying little or no gain to the higher frequencies above the threshold. In other embodiments, the amount of gain applied by the hard limiter 534 to lower frequencies is greater than the gain applied to higher frequencies. More generally, any dynamic range compressor can be used in place of the hard limiter 534. The hard limiter 534 is optional and may be omitted in some embodiments.

Either of the enhancement components 518 may be omitted, replaced with other enhancement features, or combined with other enhancement features.

III. Example Inverse HRTF Features

The characteristics of example inverse HRTFs 520 will now be described in greater detail. As will be seen, the inverse HRTFs 520 can be designed so as to further facilitate elimination of the crosstalk path filters 110 (FIG. 1). Thus, in certain embodiments, any combination of the characteristics of the inverse HRTFs, the acoustic dipole, and the ITD component can facilitate eliminating the usage of the computationally-intensive crosstalk path filters 110.

Figure 6:
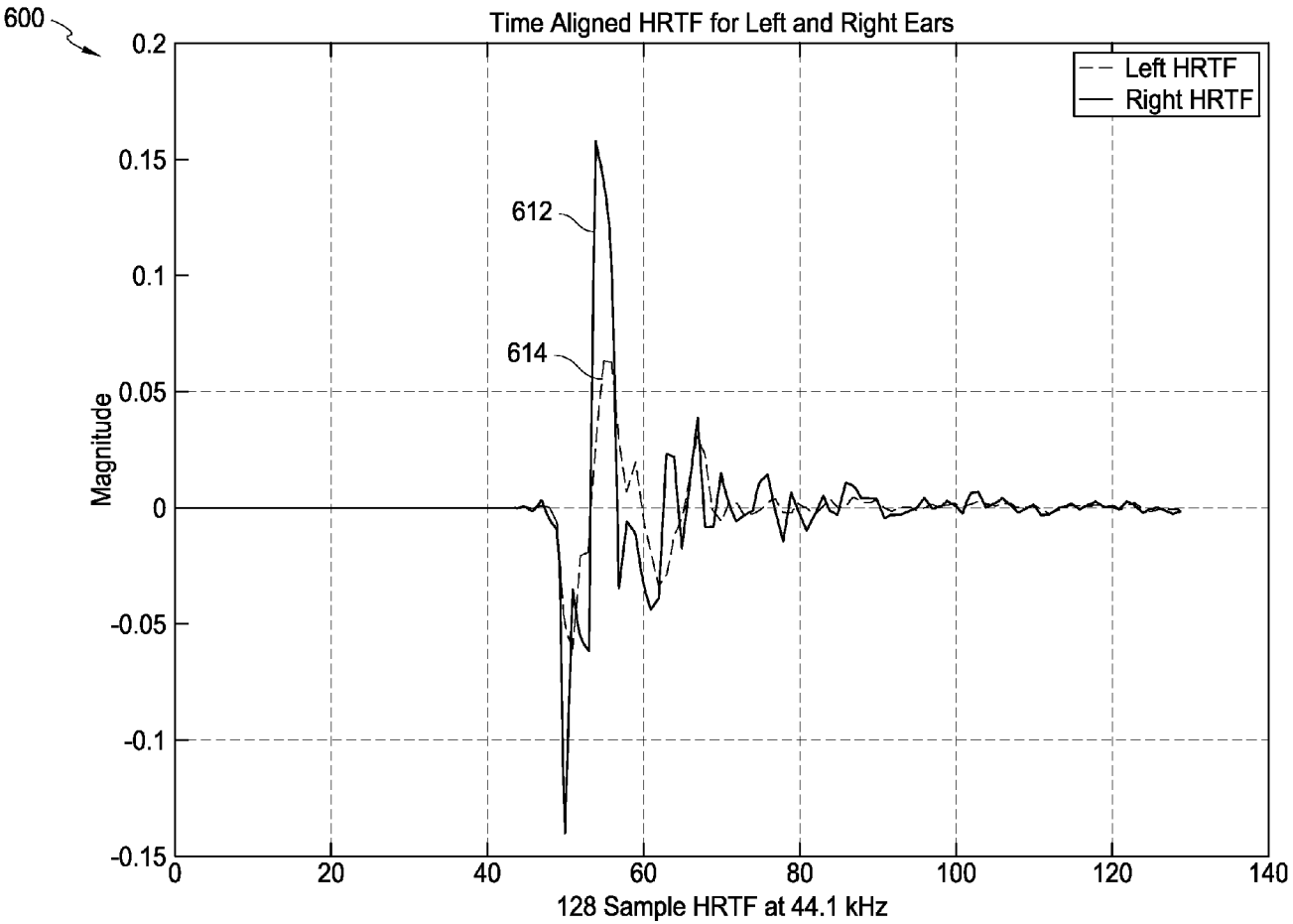
FIG. 6 illustrates a time domain plot of example head-related transfer functions (HRTF).

FIG. 6 illustrates a time domain plot 600 of example head-related transfer functions (HRTF) 612, 614 that can be used to design an improved inverse HRTF for use in the stereo widening system 400 or 500. Each HRTF 612, 614 represents a simulated hearing response function for a listener's ear. For example, the HRTF 612 could be for the right ear and the HRTF 614 could be for the left ear, or vice versa. Although time-aligned, the HRTFs 612, 614 may be delayed from one another to create an ITD in some embodiments.

HRTFs are typically measured at a 1 meter distance. Databases of such HRTFs are commercially available. However, a mobile device is typically held by a user in a range of 25-50 cm from the listener's head. To generate an HRTF that more accurately reflects this listening range, in certain embodiments, a commercially-available HRTF can be selected from a database (or generated at the 1 m range). The selected HRTF can then be scaled down in magnitude by a selected amount, such as by about 3 dB, or about 2-6 dB, or about 1-12 dB, or some other value. However, given that the typical distance of the handset to a user's ears is about half that of the 1 m distance measured for typical HRTFs (50 cm), a 3 dB difference can provide good results in some embodiments. Other ranges, however, may provide at least some or all of the desirable effects as well.

In the depicted example, an IID is created between left and right channels by scaling down the HRTF 614 by 3 dB (or some other value). Thus, the HRTF 614 is smaller in magnitude than the HRTF 612.

Figure 7:
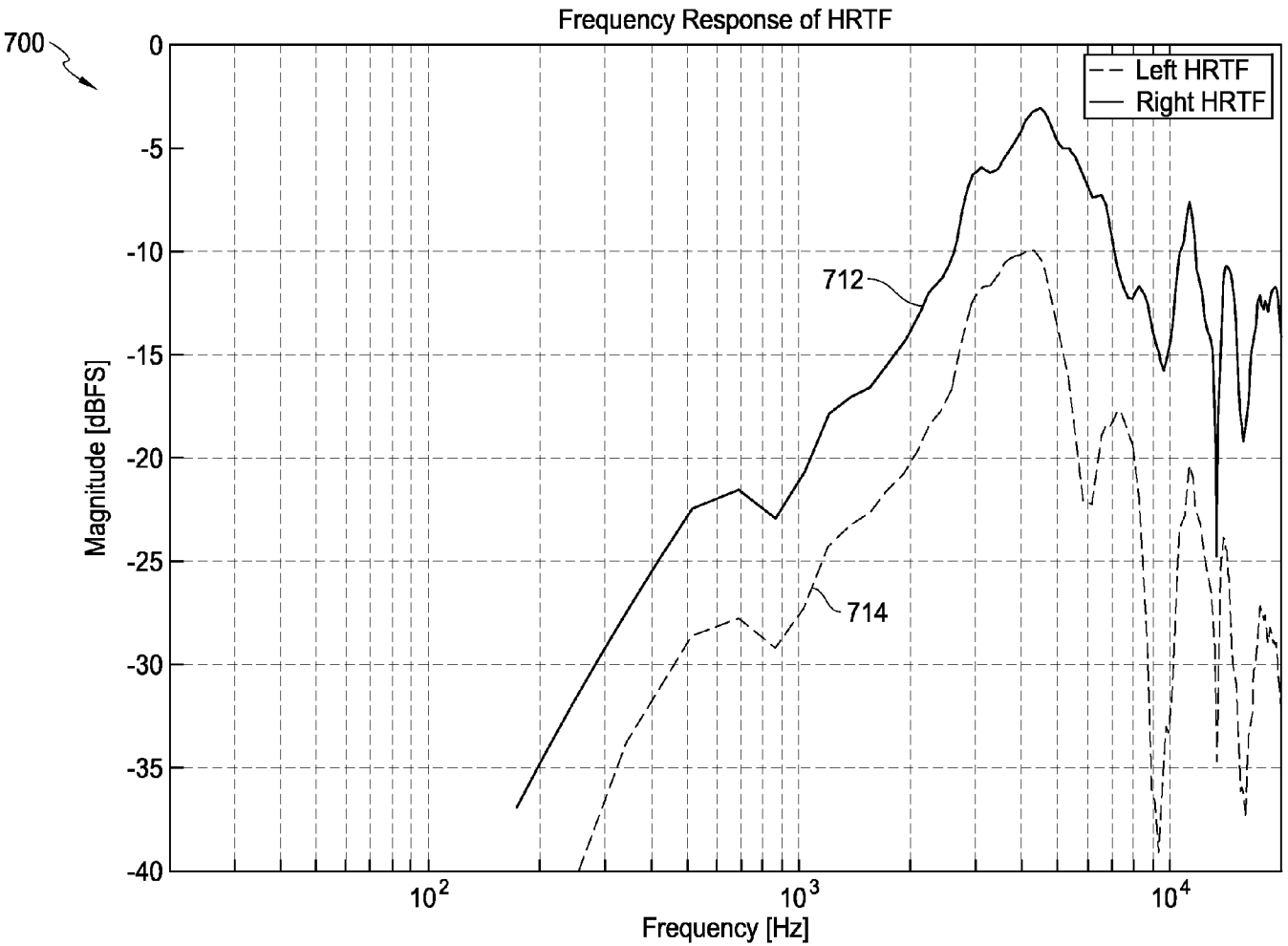
FIG. 7 illustrates a frequency response plot of the example HRTFs of FIG. 6.

FIG. 7 illustrates a frequency response plot 700 of the example HRTFs 612, 614 of FIG. 6. In the plot 700, frequency responses 712, 714 of the HRTFs 612, 614 are shown, respectively. The example frequency responses 712, 714 shown can cause a sound source to be perceived as being located 5 degrees on the right at a 25-50 cm distance range. These frequency responses may be adjusted, however, to create a perception of the sound source coming from a different location.

Figure 8:
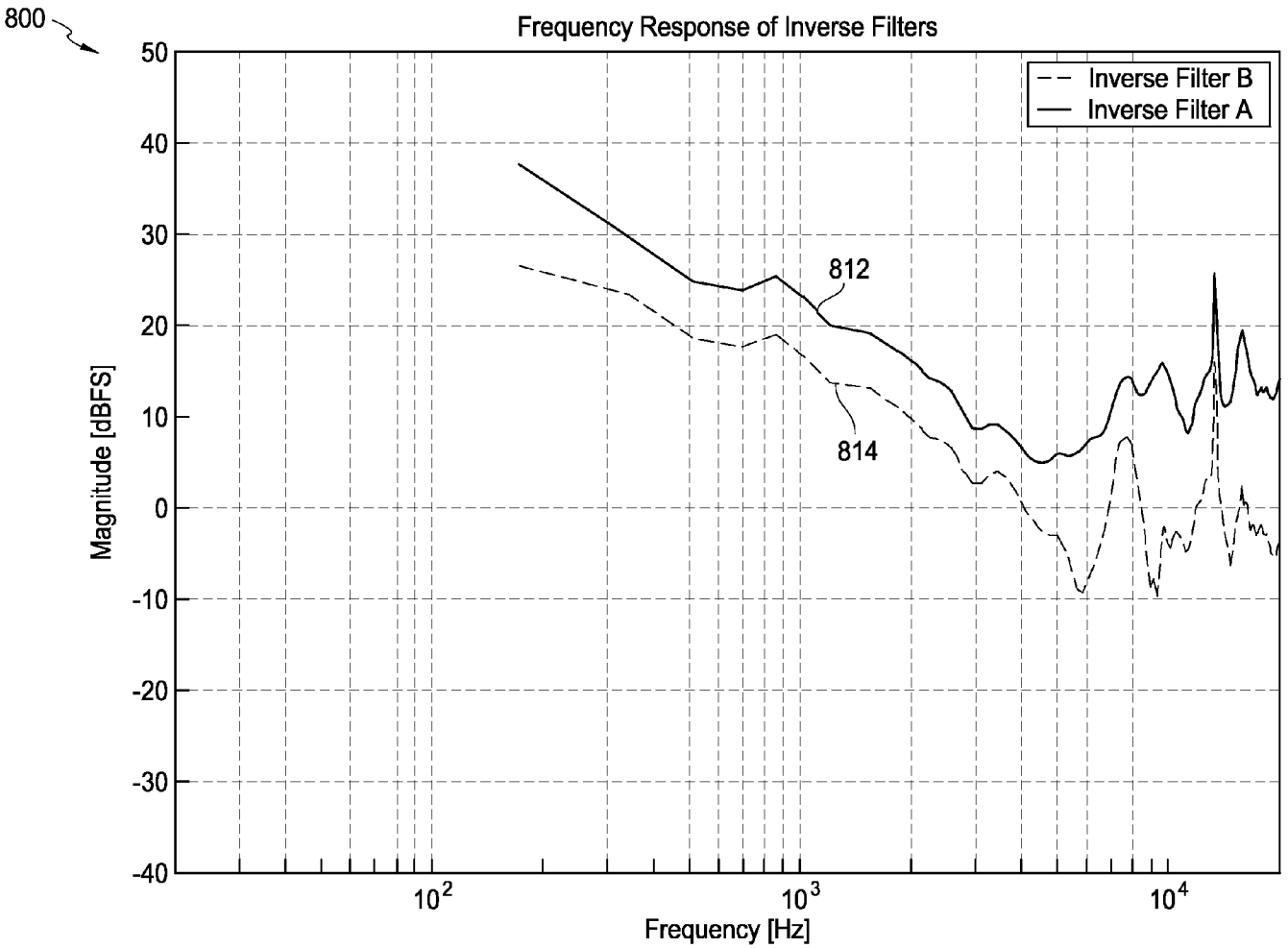
FIG. 8 illustrates a frequency response plot of inverse HRTFs obtained by inverting the HRTFs of FIG. 7.

FIG. 8 illustrates a frequency response plot 800 of inverse HRTFs 812, 814 obtained by inverting the HRTF frequency responses 712, 714 of FIG. 7. In an embodiment, the inverse HRTFs 812, 814 are additive inverses. Inverse HRTFs 812, 814 can be useful for crosstalk reduction or cancellation because a non-inverted HRTF can represent the actual transfer function from a speaker to an ear, and thus the inverse of that function can be used to cancel or reduce the crosstalk. The frequency responses of the example inverse HRTFs 812, 814 shown are different, particularly in higher frequencies. These differences are commonly exploited in crosstalk cancellation algorithms. For instance, the HRTF 812 can be used as the direct path filters 112 of FIG. 1, while the HRTF 814 can be used as the crosstalk path filters 110. These filters can advantageously be adapted to create a direct path filter 112 that obviates or reduces the need for using crosstalk path filters 110 to widen a stereo image.

Figure 9:
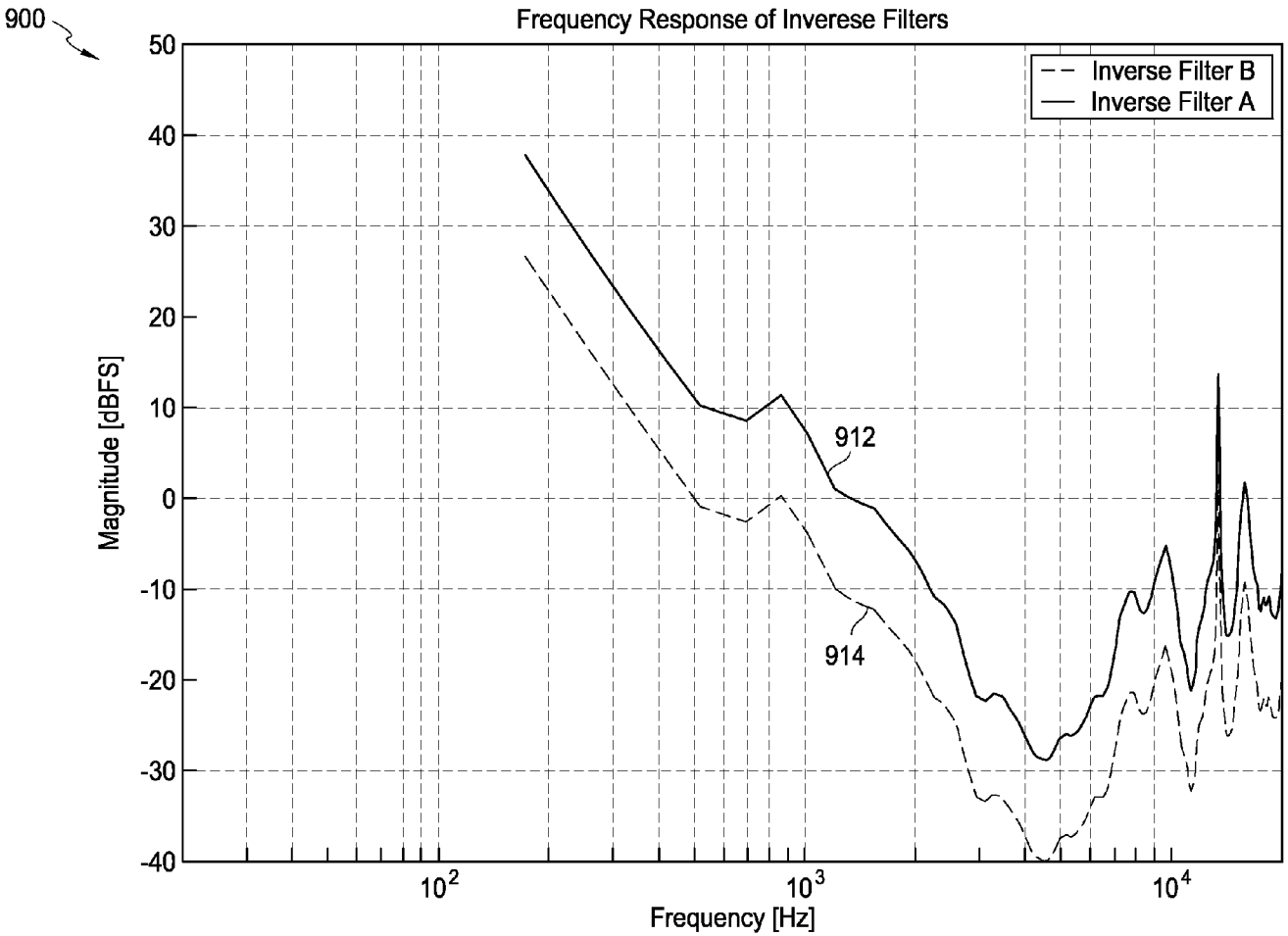
FIG. 9 illustrates a frequency response plot of inverse HRTFs obtained by manipulating the inverse HRTFs of FIG. 8.

FIG. 9 illustrates a frequency response plot 900 of inverse HRTFs 912, 914 obtained by manipulating the inverse HRTFs 812, 814 of FIG. 8. These inverse HRTFs 912, 914 were obtained by experimenting with adjusting parameters of the inverse HRTFs 812, 814 and by testing the inverse HRTFs on several different mobile devices and with a blind listening test. It was found that, in some embodiments, attenuating the lower frequencies can provide a good stereo widening effect without substantially changing color of the sound. Alternatively, attenuation of higher frequencies is also possible. Attenuation of low frequencies occurs with the inverse filters 912, 914 shown because the inverse filters are multiplicative inverses of example crosstalk HRTFs between speakers and a listener's ears (see, e.g., FIG. 7 for low-frequency attenuation for a different pair of inverse HRTFs). Thus, although the low frequencies in the frequency response plot 900 shown are emphasized by the inverse filters 912, 914, the actual low frequencies of the crosstalk are deemphasized.

Figure 10:
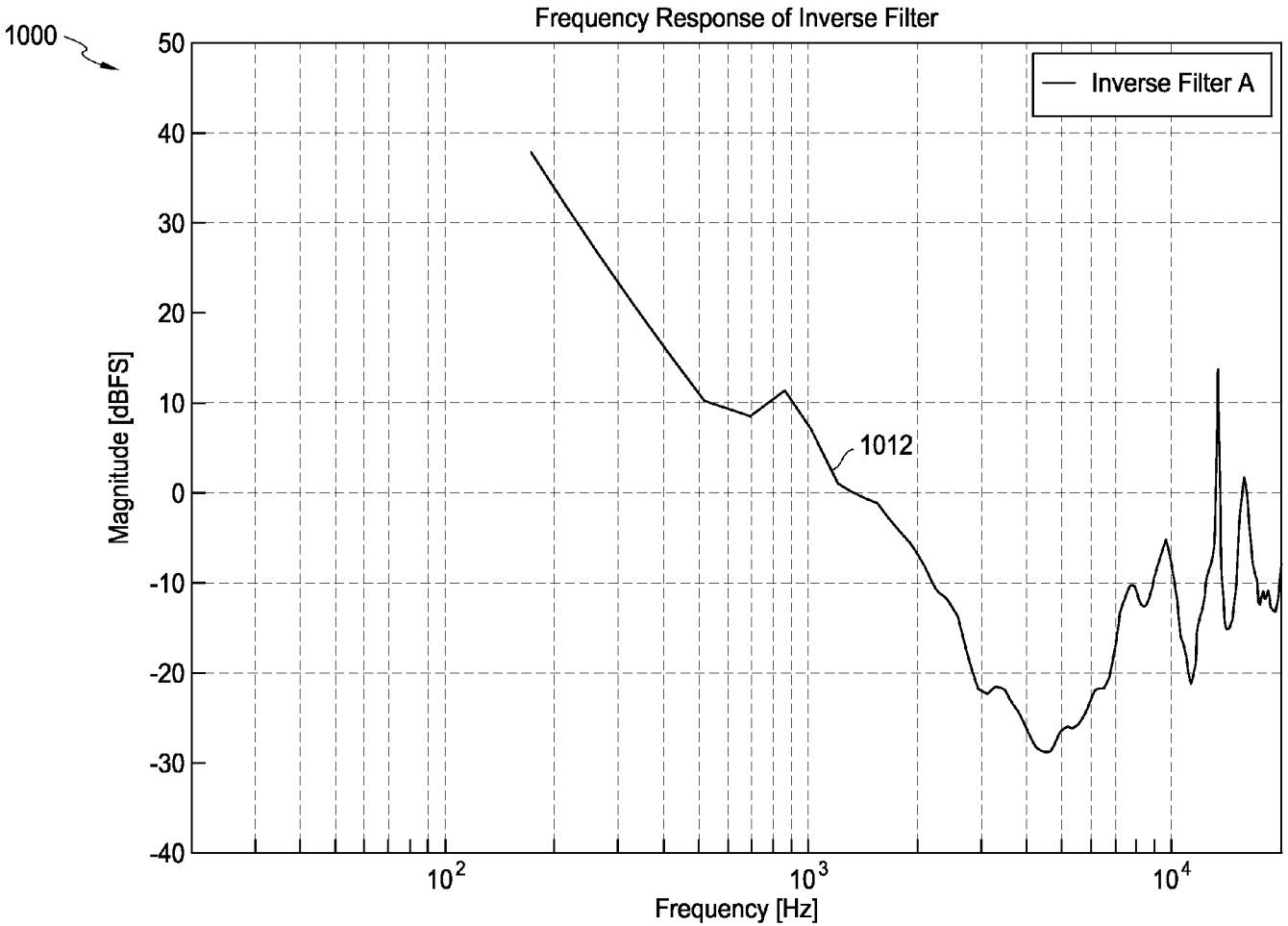
FIG. 10 illustrates a frequency response plot of one of the inverse HRTFs of FIG. 9.

As can be seen, the inverse HRTFs 912, 914 are similar in frequency characteristics. This similarity occurs in one embodiment because the distance between speakers in handheld devices or other small devices can be relatively small, resulting in similar inverse HRTFs to reduce crosstalk from each speaker. Advantageously, because of this similarity, one of the inverse HRTFs 912, 914 can be dropped from the crosstalk processing shown in FIG. 1. Thus, as shown in FIG. 10, for example, a single inverse HRTF 1012 can be used in the stereo widening system 400, 500 (the inverse HRTF 1012 shown can be scaled to any desired gain level). In particular, the crosstalk path filters 110 can be dropped from processing. The previous computations with the four filters 110, 112 can include 4 FFT (Fast Fourier Transform) convolutions and 4 IFFT (Inverse FFT) convolutions in total. By dropping the crosstalk path filters 110, the FFT/IFFT computations can be halved without sacrificing much audio performance. The inverse HRTF filtering could instead be performed in the time domain As described above, the IID component 430 can apply a different gain to the inverse HRTF in each channel (or a gain to one channel but not the other), to thereby compensate for the similarity or sameness of the inverse HRTF applied to each channel. Applying a gain can be far less processing intensive than applying a second inverse HRTF in each channel. As used herein, in addition to having its ordinary meaning, the term "gain" can also denote attenuation in some embodiments.

The frequency characteristics of the inverse HRTF 1012 include a generally attenuating response in a frequency band starting at about 700 to 900 Hz and reaching a trough at between about 3 kHz and 4 kHz. From about 4 kHz to between about 9 kHz and about 10 kHz, the frequency response generally increases in magnitude. In a range starting at between about 9 kHz to 10 kHz and continuing to at least about 11 kHz, the inverse HRTF 1012 has a more oscillatory response, with two prominent peaks in the 10 kHz to 11 kHz range. Although not shown, the inverse HRTF 1012 may also have spectral characteristics above 11 kHz, including up to the end of the audible spectrum around about 20 kHz. Further, the inverse HRTF 1012 is shown as having no effect on lower frequencies below about 700 to 900 Hz. However, in alternate embodiments, the inverse HRTF 1012 has a response in these frequencies. Preferably such response is an attenuating effect at low frequencies. However, neutral (flat) or emphasizing effects may also be beneficial in some embodiments.

Figure 11:
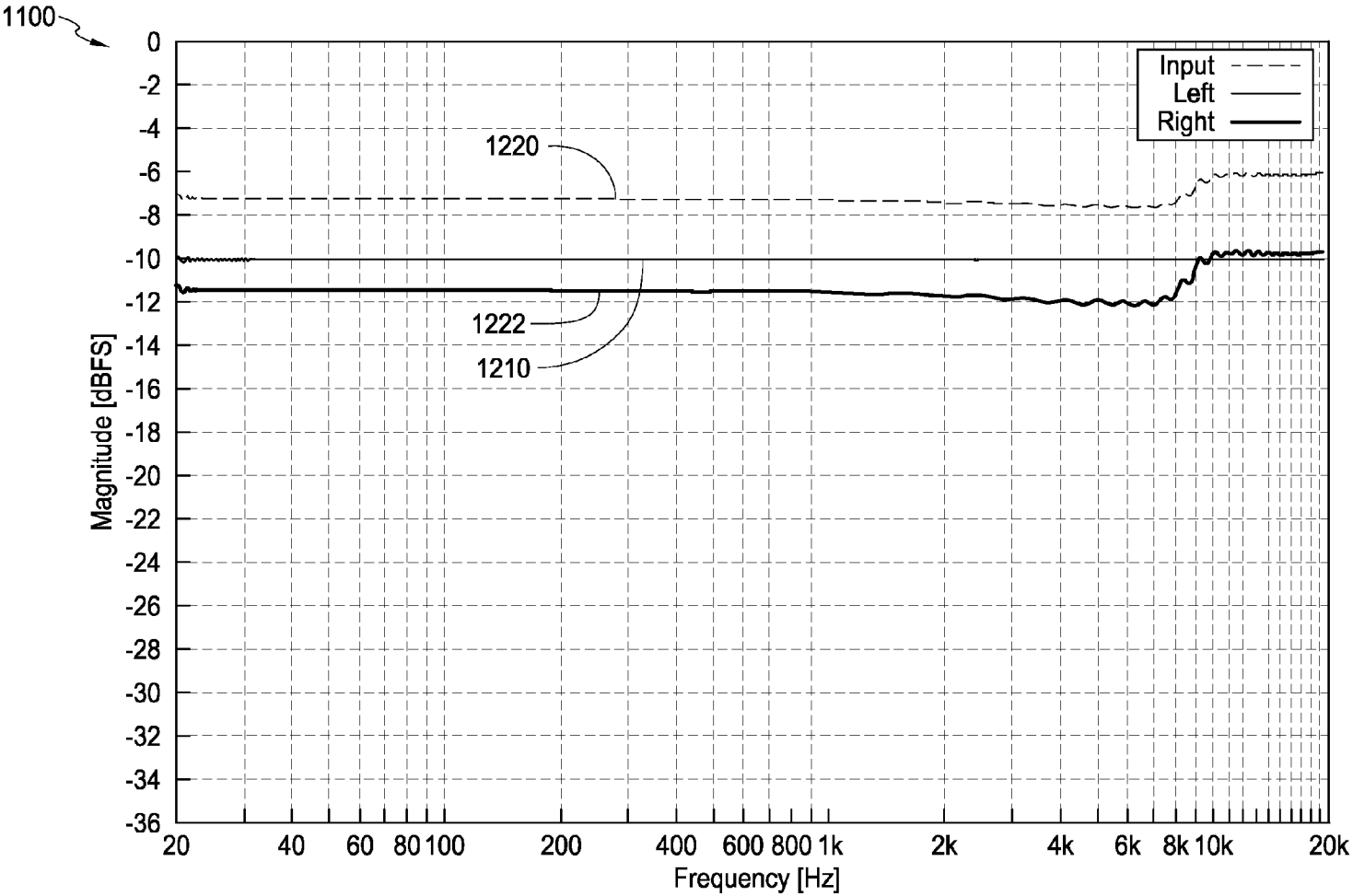
FIG. 11 illustrates a frequency sweep plot of an embodiment of the stereo widening system.

FIG. 11 illustrates an example frequency sweep plot 1100 of an embodiment of the stereo widening system 500 specific to one example speaker configuration. To produce the plot 1100, a log sweep 1210 was fed into the left channel of the stereo widening system 500, while the right channel was silent. The resulting output of the system 500 includes a left output 1220 and a right output 1222. Each of these outputs has a substantially flat frequency response through most or all of the audible spectrum from 20 Hz to 20 kHz. These substantially flat frequency responses indicate that the color of the sound is substantially unchanged despite the processing described above. In one embodiment, the shape of the inverse HRTF 1012 and/or the hard limiter 534 facilitates this substantially flat response to reduce a change in the color of sound and reduce a low frequency distortion from small speakers. The hard limiter 534, in particular, can boost low frequencies to improve the flatness of the frequency response without clipping in the high frequencies. The hard limiter 534 boosts low frequencies in certain embodiments to compensate for the change in color caused by the inverse HRTF 1012. In some embodiments, an inverse HRTF is constructed that attenuates high frequencies instead of low frequencies. In such embodiments, the hard limiter 534 can emphasize higher frequencies while limiting or deemphasizing lower frequencies to produce a substantially flat frequency response.

IV. Additional Embodiments

It should be noted that in some embodiments, the left and right audio signals can be read from a digital file, such as on a computer-readable medium (e.g., a DVD, Blu-Ray disc, hard drive, or the like). In another embodiment, the left and right audio signals can be an audio stream received over a network. The left and right audio signals may be encoded with Circle Surround encoding information, such that decoding the left and right audio signals can produce more than two output signals. In another embodiment, the left and right signals are synthesized initially from a monophone ("mono") signal. Many other configurations are possible. Further, in some embodiments, either of the inverse HRTFs of FIG. 8 can be used by the stereo widening system 400, 500 in place of the modified inverse HRTF shown in FIGS. 9 and 10.

V. Terminology

Many other variations than those described herein will be apparent from this disclosure. For example, depending on the embodiment, certain acts, events, or functions of any of the algorithms described herein can be performed in a different sequence, can be added, merged, or left out all together (e.g., not all described acts or events are necessary for the practice of the algorithms). Moreover, in certain embodiments, acts or events can be performed concurrently, e.g., through multithreaded processing, interrupt processing, or multiple processors or processor cores or on other parallel architectures, rather than sequentially. In addition, different tasks or processes can be performed by different machines and/or computing systems that can function together.

The various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality.

Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The various illustrative logical blocks and modules described in connection with the embodiments disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration. Although described herein primarily with respect to digital technology, a processor may also include primarily analog components. For example, any of the signal processing algorithms described herein may be implemented in analog circuitry. A computing environment can include any type of computer system, including, but not limited to, a computer system based on a microprocessor, a mainframe computer, a digital signal processor, a portable computing device, a personal organizer, a device controller, and a computational engine within an appliance, to name a few.

The steps of a method, process, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

What is claimed is:

1. A method for virtually widening stereo audio signals played over a pair of loudspeakers, the method comprising:

receiving stereo audio signals, the stereo audio signals comprising a left audio signal and a right audio signal;

supplying the left audio signal to a left channel and the right audio signal to a right channel;

employing acoustic dipole principles to mitigate effects of crosstalk between a pair of loudspeakers and opposite ears of a listener, without employing any computationally-intensive head-related transfer functions (HRTFs) in an attempt to completely cancel the crosstalk, said employing comprising, by one or more processors:

approximating a first acoustic dipole by at least (a) inverting the left audio signal to produce a inverted left audio signal and (b) combining the inverted left audio signal with the right audio signal, and approximating a second acoustic dipole by at least (a) inverting the right audio signal to produce a inverted right audio signal and (b) combining the inverted right audio signal with the left audio signal;

applying a single first inverse HRTF to the first acoustic dipole to produce a left filtered signal, the first inverse HRTF being applied in a first direct path of the left channel rather than a first crosstalk path from the left channel to the right channel;

applying a single second inverse HRTF function to the second acoustic dipole to produce a right filtered signal, the second inverse HRTF being applied in a second direct path of the right channel rather than a second crosstalk path from the right channel to the left channel, wherein the first and second inverse HRTFs provide an interaural intensity difference (IID) between the left and right filtered signals;

enhancing the left and right filtered signals using a processor, said enhancing comprising:

high-pass filtering the left filtered signal to produce a second left filtered signal, thereby reducing low frequency distortion in the left filtered signal, and high-pass filtering the right filtered signal to produce a second right filtered signal, thereby reducing low frequency distortion in the right filtered signal; and supplying the second left and right filtered signals for playback on the pair of loudspeakers to thereby provide a stereo image configured to be perceived by the listener to be wider than an actual distance between the left and right loudspeakers.

2. The method of claim 1, wherein said approximating the first acoustic dipole further comprises applying a first delay to the left audio signal, and wherein said approximating the second acoustic dipole further comprises applying a second delay to the right audio signal, the first and second delays being selected so as to provide an interaural time delay (ITD).

3. The method of claim 1, wherein said enhancing further comprises performing dynamic range compression of one or both of the left and right audio signals to boost lower frequencies relatively more than higher frequencies, so as to avoid clipping higher frequencies.

4. The method of claim 3, wherein said performing the dynamic range compression comprises applying a limiter to one or both of the left and right filtered signals.

5. A method for virtually widening stereo audio signals played over a pair of loudspeakers, the method comprising:

receiving stereo audio signals, the stereo audio signals comprising a left audio signal and a right audio signal;

supplying the left audio signal to a left channel and the right audio signal to a right channel;

employing acoustic dipole principles to mitigate effects of crosstalk between a pair of loudspeakers and opposite ears of a listener, without employing any computationally-intensive head-related transfer functions (HRTFs) in an attempt to completely cancel the crosstalk, said employing comprising, by one or more processors:

approximating a first acoustic dipole by at least (a) inverting the left audio signal to produce a inverted left audio signal and (b) combining the inverted left audio signal with the right audio signal, and approximating a second acoustic dipole by at least (a) inverting the right audio signal to produce a inverted right audio signal and (b) combining the inverted right audio signal with the left audio signal;

applying a single first inverse HRTF to the first acoustic dipole to produce a left filtered signal, the first inverse HRTF being applied in a first direct path of the left channel rather than a first crosstalk path from the left channel to the right channel;

applying a single second inverse HRTF function to the second acoustic dipole to produce a right filtered signal, the second inverse HRTF being applied in a second direct path of the right channel rather than a second crosstalk path from the right channel to the left channel, wherein the first and second inverse HRTFs provide an interaural intensity difference (IID) between the left and right filtered signals;

enhancing the left and right filtered signals using a processor to produce enhanced left and right filtered signals, said enhancing comprising performing dynamic range compression of one or both of the left and right audio signals to boost lower frequencies relatively more than higher frequencies, so as to avoid clipping higher frequencies; and supplying the enhanced left and right filtered signals for playback on the pair of loudspeakers to thereby provide a stereo image configured to be perceived by the listener to be wider than an actual distance between the left and right loudspeakers.

6. The method of claim 5, wherein said enhancing further comprises:

high-pass filtering the enhanced left filtered signal to produce a second left filtered signal, thereby reducing low frequency distortion in the enhanced left filtered signal; and high-pass filtering the enhanced right filtered signal to produce a second right filtered signal, thereby reducing low frequency distortion in the enhanced right filtered signal.

7. The method of claim 5, wherein said performing the dynamic range compression comprises applying a limiter to one or both of the enhanced left and right filtered signals.

8. The method of claim 5, wherein said approximating the first acoustic dipole further comprises applying a first delay to the left audio signal, and wherein said approximating the second acoustic dipole further comprises applying a second delay to the right audio signal, the first and second delays being selected so as to provide an interaural time delay (ITD).

* * * * *